US006135834A

United States Patent [19]

Polakowski

[11] Patent Number: 6,135,834

[45] Date of Patent: Oct. 24, 2000

[54] WATERCRAFT EXHAUST GAS CONTROL SYSTEM AND METHOD

[76] Inventor: Stephen E. Polakowski, 1523 Ravine Side Dr., Houghton, Mich. 49931

[21] Appl. No.: 09/234,642

[22] Filed: Jan. 21, 1999

Related U.S. Application Data

[60] Provisional application No. 60/072,038, Jan. 21, 1998.

[51] Int. Cl.[7] ..... B63H 21/32

[52] U.S. Cl. ..... 440/89; 440/45; 114/123

[58] Field of Search ..... 440/45, 89; 114/123

[56] References Cited

U.S. PATENT DOCUMENTS

| | | | |
|---|---|---|---|
| 359,952 | 3/1887 | Archer | 60/222 |
| 676,164 | 6/1901 | Villar | 60/229 |
| 3,865,067 | 2/1975 | Archer . | |
| 4,863,404 | 9/1989 | Salo | 440/38 |
| 4,907,520 | 3/1990 | Pipkorn . | |
| 5,007,870 | 4/1991 | Okubo et al. . | |
| 5,078,631 | 1/1992 | Harbert | 440/89 |
| 5,090,929 | 2/1992 | Rieben . | |
| 5,094,640 | 3/1992 | Burdick et al. | 440/89 |
| 5,129,846 | 7/1992 | Dimijian . | |
| 5,253,603 | 10/1993 | Mascolo . | |
| 5,389,022 | 2/1995 | Kobayashi . | |
| 5,556,314 | 9/1996 | Fukuda et al. . | |

FOREIGN PATENT DOCUMENTS

| | | |
|---|---|---|
| 446915 | 5/1936 | United Kingdom . |
| 1 418 636 | 12/1975 | United Kingdom . |

*Primary Examiner*—S. Joseph Morano
*Assistant Examiner*—Andrew D. Wright
*Attorney, Agent, or Firm*—Richard C. Litman

[57] ABSTRACT

A personal watercraft having exhaust pipes which discharge exhaust gases to either side of the craft's hull, is disclosed The exhaust system of the personal watercraft has one or more valves which can be used to selectively direct exhaust gases to one side or the other of the hull to thereby generate a steering force to at least aid in the steering of the personal watercraft. Also disclosed, are a pair of sponsons with perforated bottoms which are attached to either side of the hull. Exhaust gases are directed into the sponsons which release exhaust gas bubbles under the waterline and thus muffle the exhaust noise. In conjunction with the sponsons, multi-compartment tuning chambers can be provided inside the hull. A method for steering a personal watercraft using exhaust gases and a method and arrangement for automatically shutting off exhaust gas flow when the craft leaves the water, are also disclosed.

13 Claims, 15 Drawing Sheets

WATERCRAFT EXHAUST GAS CONTROL SYSTEM AND METHOD

CROSS-REFERENCE TO RELATED APPLICATION

This application claims the benefit of U.S. Provisional Patent Application Ser. No. 60/072,038, filed Jan. 21, 1998.

FIELD OF THE INVENTION

The present invention relates to several embodiments of exhaust systems for personal watercrafts (PWCs). More specifically, the exhaust systems of the present invention include sponsons that reduce exhaust noise by diffusing the exhaust gases and releasing them beneath the waterline. In addition, the exhaust systems include a mechanism for directing the exhaust gases to provide off-throttle steering and increased stability for PWCs.

DESCRIPTION OF RELATED ART

In the past few years, personal watercrafts (PWCs) have become more and more popular. Unfortunately, PWCs tend to be very loud, and relatively unstable. In addition, because these craft are steered by directing the thrust of a water jet, there is no provision in the prior art PWCs, for off-throttle steering (as by a rudder in conventional watercraft). This can result in a dangerous situation, when it is necessary to both slow down and steer to avoid a collision.

Several patents are directed to reducing noise and increasing steerability in PWCs and other watercraft. U.S. Pat. No. 3,865,067, issued on Feb. 11, 1975 to Archer, discloses a propulsion and steering system for boats that includes a multiplicity of jet nozzles. Selective flow of water to the nozzles provides directional control of the boat. U.S. Pat. No. 5,129,846, issued on Jul. 14, 1992 to Dimijian, discloses a vessel propulsion and turning control system having valves for selective directional control of the vessel. The valves control water jets and are not associated with the exhaust system.

U.S. Pat. No. 5,007,870, issued on Apr. 16, 1991 to Okubo et al., shows a PWC exhaust noise eliminating apparatus that includes a multi-chambered exhaust path and an outlet port that directs the gases downward at the rear of the PWC. U.S. Pat. No. 5,233,603, issued on Oct. 19, 1993 to Mascolo, teaches an underwater vehicle muffler that produces smaller exhaust bubbles to thereby reduce exhaust noise. U.S. Pat. No. 5,389,022, issued on Feb. 14, 1995 to Kobayashi, discloses a jet boat having an improved exhaust silencing device. The exhaust system includes an expansion chamber, and a perforated conduit that extends through the expansion chamber. Exhaust gases are released underwater via a check valve formed as a rubber flapper type valve. U.S. Pat No. 5,556,314, issued on Sep. 17, 1996 to Fukuda et al., shows an exhaust system for PWCs wherein exhaust gases are directed to valved ports in a tunnel underneath the PWC. Noise levels are reduced by closing ports when back pressure is below a predetermined level.

British Patent Specification 446,915, accepted May 8, 1936 from Griffith et al. discloses improvements to exhaust silencers of internal combustion engines. The improvements include directing cold air into a silencer (muffler) to reduce temperatures below ignition levels. The cold air is directed using butterfly valves somewhat similar to those used to direct exhaust gases in the present invention.

None of the above inventions and patents, taken either singly or in combination, is seen to describe the instant invention as claimed.

SUMMARY OF THE INVENTION

In the past few years, personal watercrafts or PWCs, a term including jet skis, wave runners, etc., have become increasingly popular. With the increasing numbers of these crafts, complaints concerning noise produced by these craft have also increased. Shoreline owners in particular are annoyed by this noise Legislation is in debate in several states (such as Michigan) regarding PWC use, safety and annoyance. Additionally, a major safety issue with PWCs is their lack of off-throttle steering. This is due to the fact that PWCs are steered by directing the water jet (as opposed to rudder steering in conventional watercraft). When the water jet is not produced (throttle off), the PWC will continue in a straight line path. The small size of PWCs also results in reduced stability and handling.

The present invention overcomes these drawbacks using a unique exhaust system that both reduces the noise produced by the PWC, and directs exhaust gases to improve steering and stability.

The exhaust system of the present invention includes left and right sponsons attached to left and right sides of the hull of the PWC. Exhaust gases (produced even when the engine is idling during throttle off conditions) are ported to the sponsons on the sides of the PWC; the exhaust noise is divided between both sides of the PWC (as opposed to conventional single exhaust outlets). When unevenly distributed between the left and right sides of the PWC, the exhaust gases produce a steering force. The bottom and rear surfaces of the sponsons have a plurality of apertures through which exhaust gases are released (preferably below the waterline). The plurality of apertures diffuse the exhaust, thereby reducing the overall noise produced thereby.

Several mechanisms are disclosed for controlling the distribution of exhaust gases between right and left sides of the PWC. The first of these is a lever mounted on the handle bars of the PWC. The lever is connected to a butterfly-type exhaust valve by a cable. The exhaust valve has an input connected to the PWC engine's exhaust outlet port, a left exhaust outlet connected to a left exhaust pipe leading to the left sponson, and a right exhaust outlet connected to a right exhaust pipe, leading to the right sponson.

In other embodiments, it needs to be recognized that the left-left and right-right construction of outlet-pipe-sponson arrangement just described may not be the best combination. Accordingly, a crossover construction is envisaged as being fully within the scope of the invention, with a left outlet connected to a right exhaust pipe and right sponson, and a right outlet connected to left exhaust pipe and left sponson.

In the fully extended position, the exhaust valve connects the valve input to the right exhaust outlet, and when the cable is fully retracted, the exhaust valve connects the valve input to the left exhaust outlet. When the lever is in intermediate positions, the exhaust valve variable distributes the exhaust gases between the left and right exhaust outlets. The second control mechanism uses foot pedals. A left foot pedal is operatively connected to a left exhaust valve by a first cable, and a right foot pedal is operatively connected to a right exhaust valve by a second cable. Both the right exhaust valve and the left exhaust valve include an exhaust input operatively connected to the exhaust outlet port, while the right exhaust valve outlet is connected to the right exhaust pipe and the left exhaust valve outlet is connected to the left exhaust pipe. The right exhaust valve provides a variable flow path between the right exhaust valve input and the right exhaust outlet based on the depression of the right pedal, while the left exhaust valve provides a similar function for the left side. The pedals thereby allow independent control of the right and left exhaust output through the sponsors. This is useful for both steering and attitude control of the PWC.

In addition to the manual control of the exhaust distribution by a lever or pedals, the primary arrangement for controlling exhaust distribution, the present invention also includes automatic control. The control cable used with the lever is alternatively connected to the handle bars of the PWC. In the basic embodiment, when the handle bars are turned to the left, the exhaust valve diverts the exhaust to the left sponson, and when turned to the right exhaust is diverted to the right sponson. (Of course, exhaust connections may be of the crossover type explained above, with left side exhaust directed to the right, and right side exhaust being directed to the left.) A turning force is thereby imparted to the PWC (by pushing the rear of the PWC in the opposite direction of the desired turn). In the more advanced version of the control system, the exhaust valve is controlled by an electrical device (such as a servomotor) and control electronics are included. A major advantage of an electrically controlled system is the ability to turn off the exhaust distribution using an electrical switch. This provides two modes of operation: normal, even distribution of the exhaust; and a racing or performance mode.

In addition, with the use of an electrically controlled system, several electrical sensors could be used to determine the ideal exhaust distribution. This is important as steering considerations are only part of the objectives of the exhaust system of the present invention. Side to side rolling forces can be offset by directing exhaust gases to the sponson on the lower side of the PWC. Porting the exhaust to the lowered sponson has the additional advantage of reducing exhaust noise by insuring that the exhaust is released underwater, and not through the sponson that is raised out of the water. The rearward disposition of the sponsons relative to the center of gravity of the PWC creates a forward roll, increasing the wetted keel area, and reducing porpoising.

To achieve an even greater degree of noise reduction, tuning chambers are used in conjunction with the above described exhaust system. The tuning chambers are integral with the sponsons, or are provided as separate chambers in the hull of the PWC. Two alternate embodiments of the sponsons having integral damping chambers are disclosed. The first embodiment includes a Hemholtz resonator in the front of the sponson, while the second embodiment includes an outwardly situated quarter-wave tuner. Chambers and ports (both in the separate embodiments and the integral embodiments) are tuned to minimize the resulting exhaust noise.

In addition, a method and arrangement for automatically shutting off exhaust gas flow, when the craft leaves the water under power, are also disclosed.

Accordingly, it is a principal object of the invention to reduce the noise produced by personal watercrafts (PWCs).

It is another object of the invention to port exhaust gases in a PWC to provide off-throttle steering control.

It is a further object of the invention to increase the stability and handling of a PWC.

It is an additional object of the invention to reduce porpoising in the operation of a PWC.

Still another object of the invention is to provide a steering and stability enhancement for a PWC that can be switched from an active state to an inactive state.

Yet another object of the present invention is to alleviate the loud noise and the excessive revving of the engine that accompanies jumping clear of the water during high speed travel.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
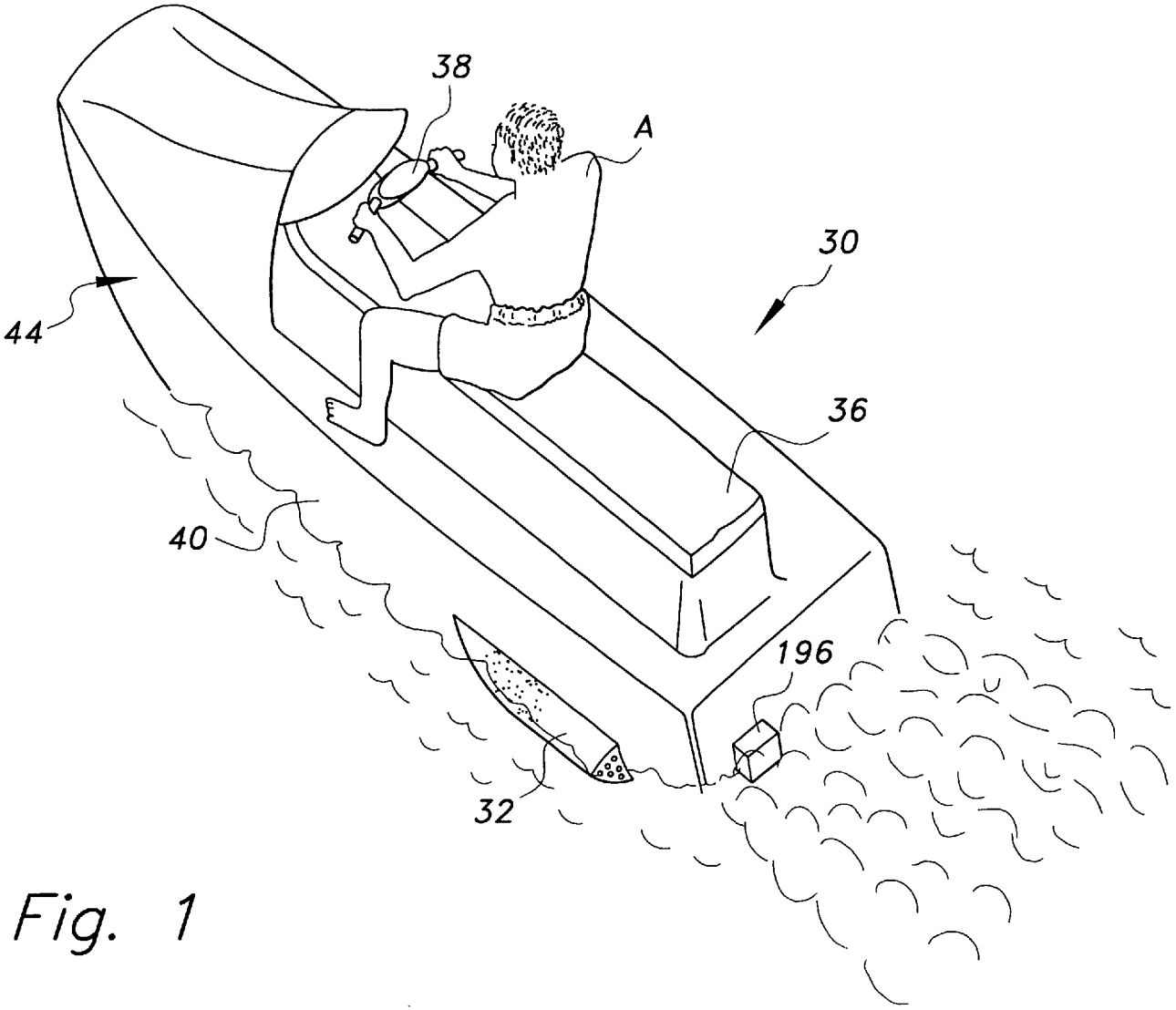
FIG. 1 is an environmental view of a personal watercraft with the exhaust system of the present invention.

Referring to FIGS. 1–10, the present invention is an exhaust system that reduces noise produced by personal watercrafts (PWCs), as well as increasing stability and providing off-throttle steering for these types of watercraft. FIG. 1 shows an environmental view of a PWC 30 equipped with a sponsons 32 and 34. The sponsons 32 and 34 are integral parts of some embodiments of the exhaust system of the present invention. The PWC 30 includes a seat 36 for one or more riders A, and handle bars 38 for steering the PWC 30. As is well known in these types of watercraft, an internal combustion engine drives a water jet that is directed by the handle bars 38 to provide steering. As previously discussed, in a conventional PWC when the throttle is off and the engine is idling, a water jet is not produced, and steering control is therefore non-existent.

Figure 2:
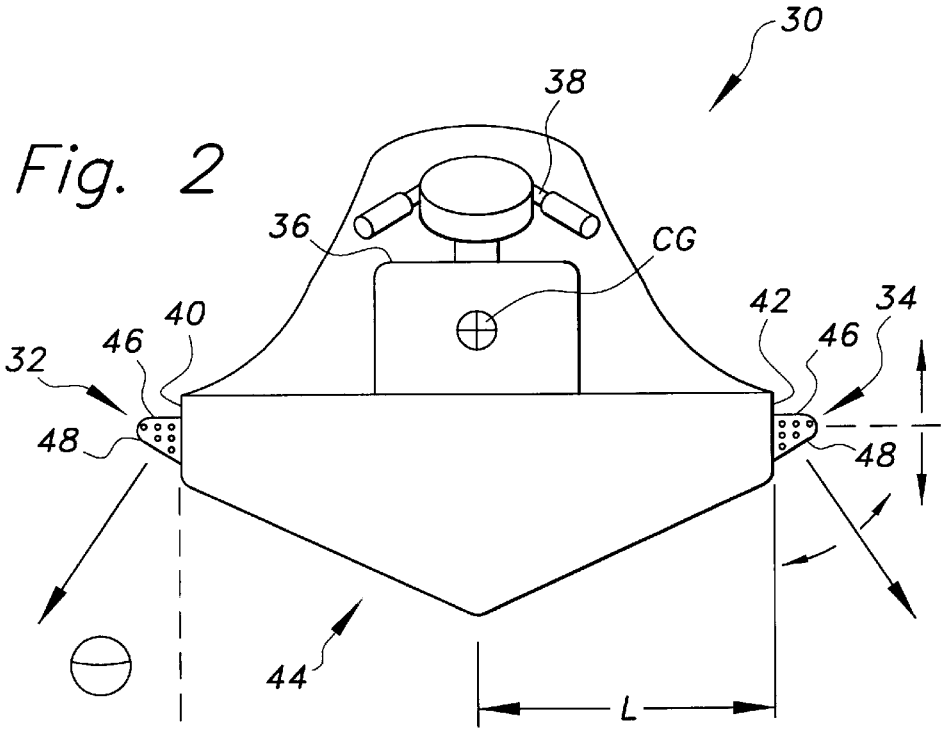
FIG. 2 is a diagrammatical rear view of the watercraft of FIG. 1, showing how the exhaust is directed upon exiting the sponsons.
Figure 4:
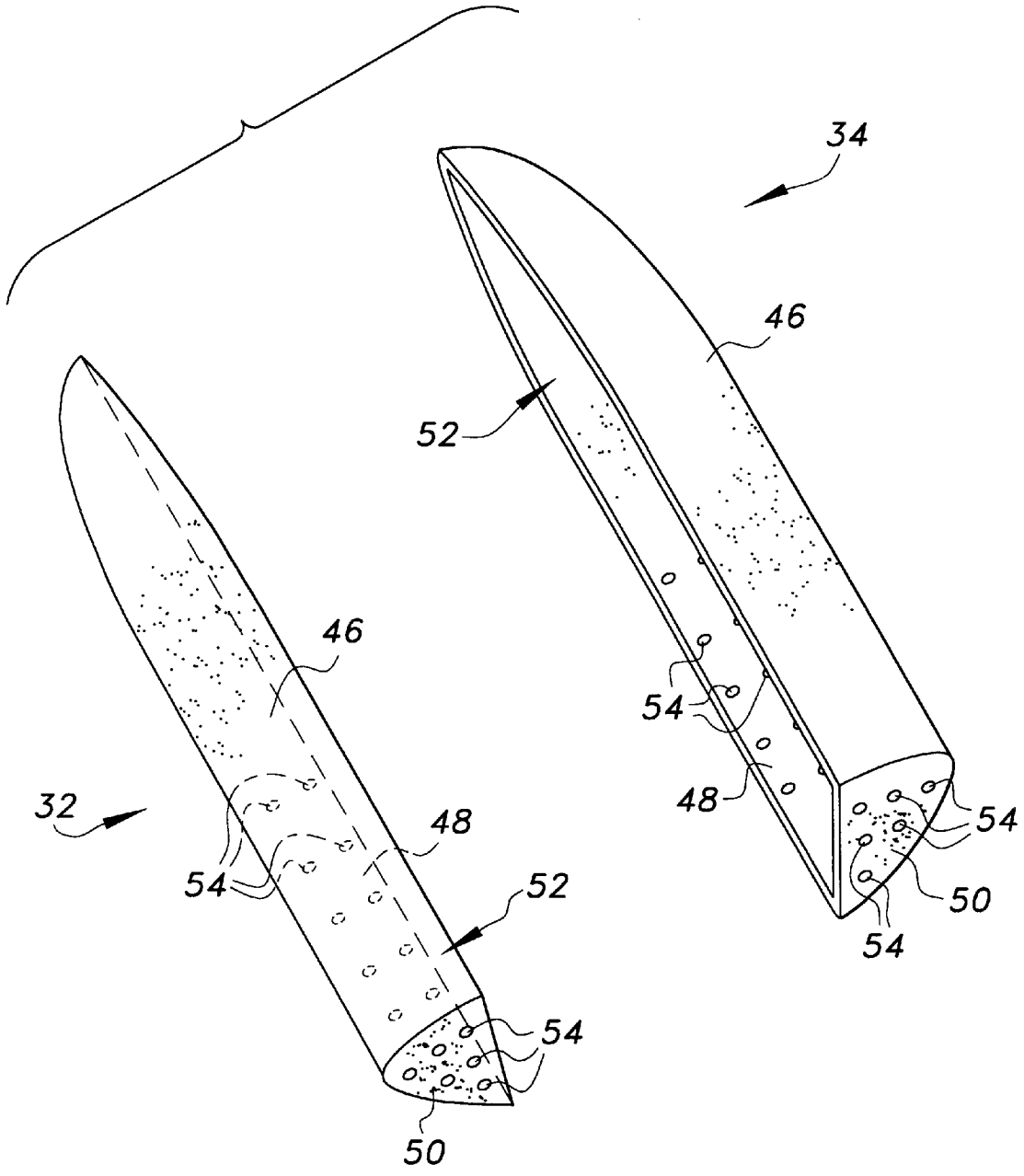
FIG. 4 is an enlarged perspective view of one of the sponsons of the exhaust system of the present invention.
Figure 17:
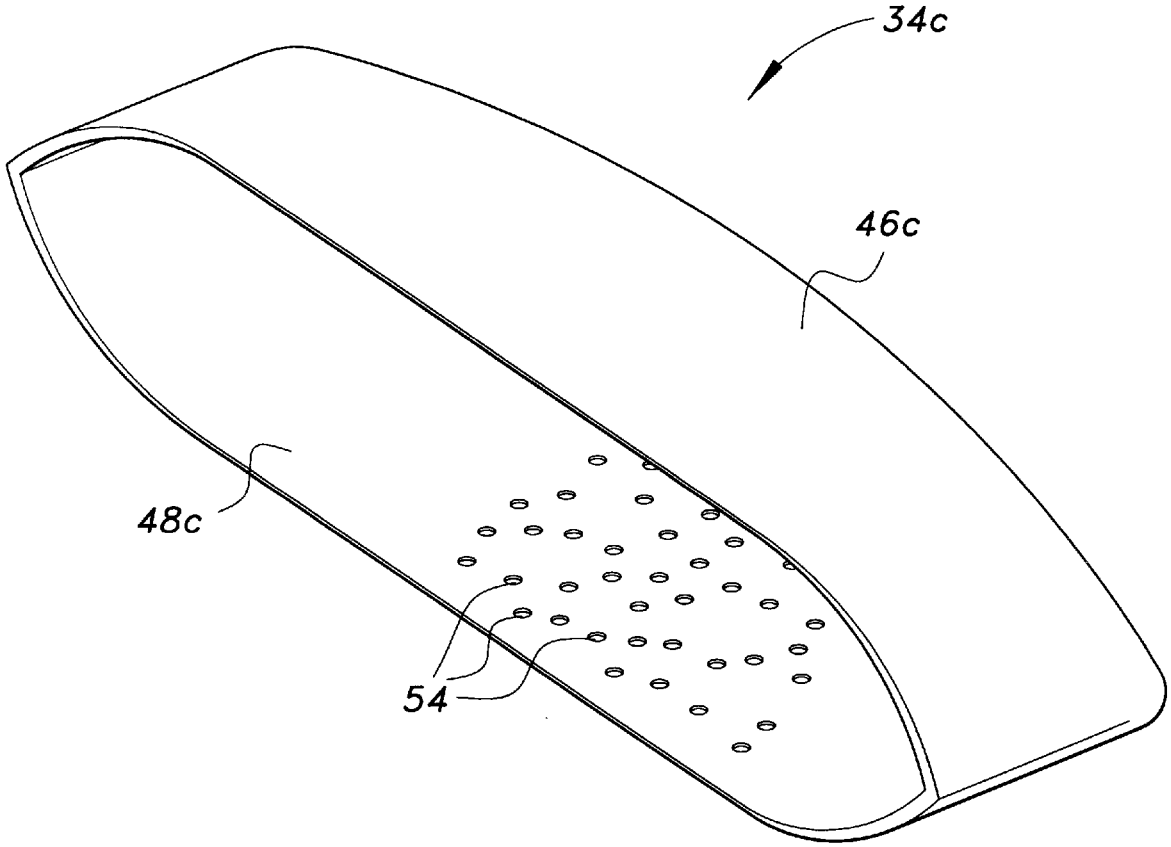
FIG. 17 is a perspective view of an alternative sponson design for use with the present invention.

To overcome this dangerous situation, the exhaust system of the present invention provides a left sponson 32 and a right sponson 34 attached to the left side 40 and the right side 42 of the hull 44, respectively (see FIG. 2). Exhaust gases (produced even when the engine is only idling) are directed to the sponsons 32 and 34 to reduce exhaust noise, and when unevenly distributed between the left and right sides of the PWC 30 result in a steering force. The magnitude of the steering and stabilizing forces imparted by the sponsons, is dependent on several factors. In FIG. 4, it can be seen that the sponsons 32 and 34 both include a top surface 46, a bottom surface 48, a rear surface 50 and a substantially open side 52. The bottom surface 48 and rear surface 50 (if determined to be necessary) both have a plurality of apertures 54 through which exhaust gases are released below the waterline. The apertures in the rear surface 50 are optional and will only be provided if necessary. Further, as shown in FIG. 17, the sponsons may be streamlined at both ends eliminating the rear wall 50. This modified sponson is indicated by reference numeral 34*c*. Therefore, it may be decided that only the bottom surface 48 needs to have apertures 54. Factors to be considered in the decision of whether or not to provide rear apertures 54 include flow requirements and/or U.S. Coast Guard regulations. The bottom surface 48 is angled such that the surface 48 increases in height with increasing distance from the sides of the hull 44, thus forming an angle θ between the exhaust thrust vector and the vertical (FIG. 2). As angle θ is increased, the horizontal component of the force imparted by the exhaust is increased, while the vertical component of the force is decreased.

Figure 3:
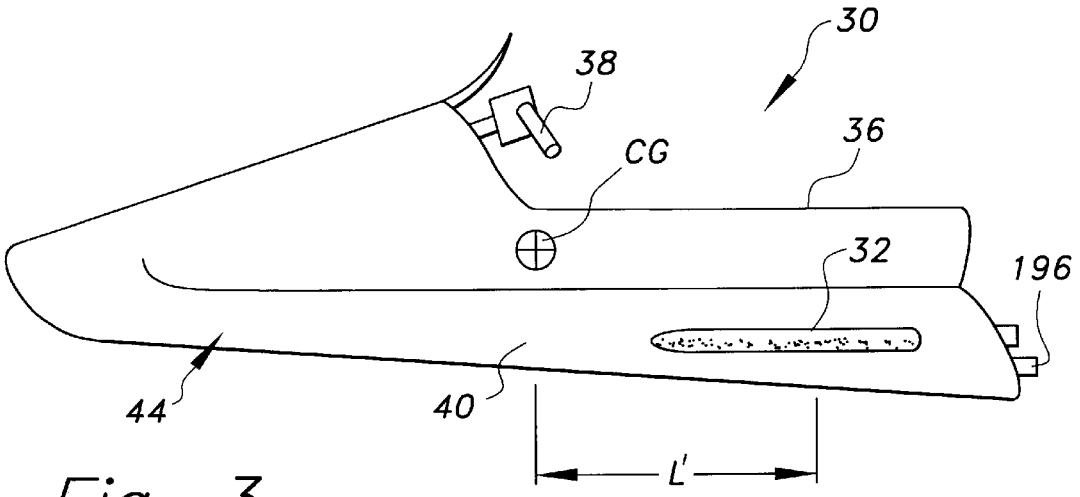
FIG. 3 is a diagrammatical side view of the watercraft of FIG. 1, showing the relationship between the sponsons and the center of gravity of the watercraft.

Other factors affecting the steering and stabilizing forces are illustrated in FIGS. 2 and 3. One of these factors is the lateral distance L the sponsons 32 and 34 are offset from the center of gravity CG. The further the sponsons 32 and 34 are mounted from the center of gravity CG the greater the turning and boat roll restoring forces applied to the hull. This is also the case when considering the longitudinal distance L' the sponsons 32 and 34 are offset from the center of gravity CG, and the resulting forward roll forces. In addition, the height of the sponsons 32 and 34 relative to the waterline can be selected for maximum damping of the exhaust noise, or for stability and attitude control as discussed below. While the sponsons 32 and 34 are intended to be fixed to the sides or the hull, their heights, longitudinal and lateral positions can be adjustable using a suitable mechanism.

Figure 8:
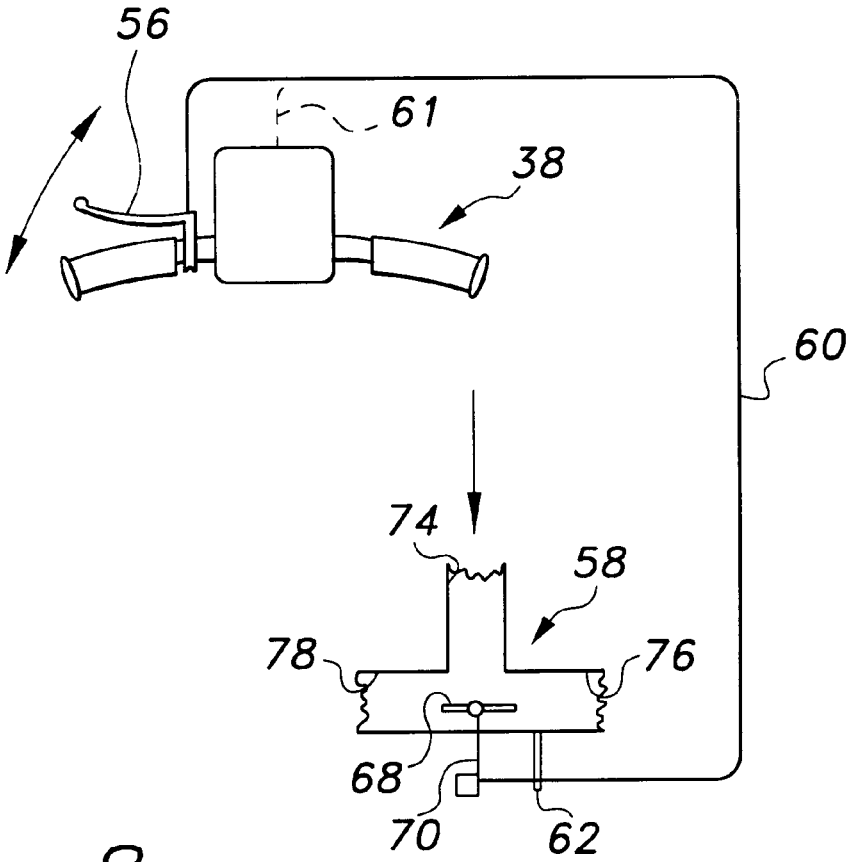
FIG. 8 is a schematic view of a first embodiment of a steering mechanism used with the exhaust system of the present invention.
Figure 9:
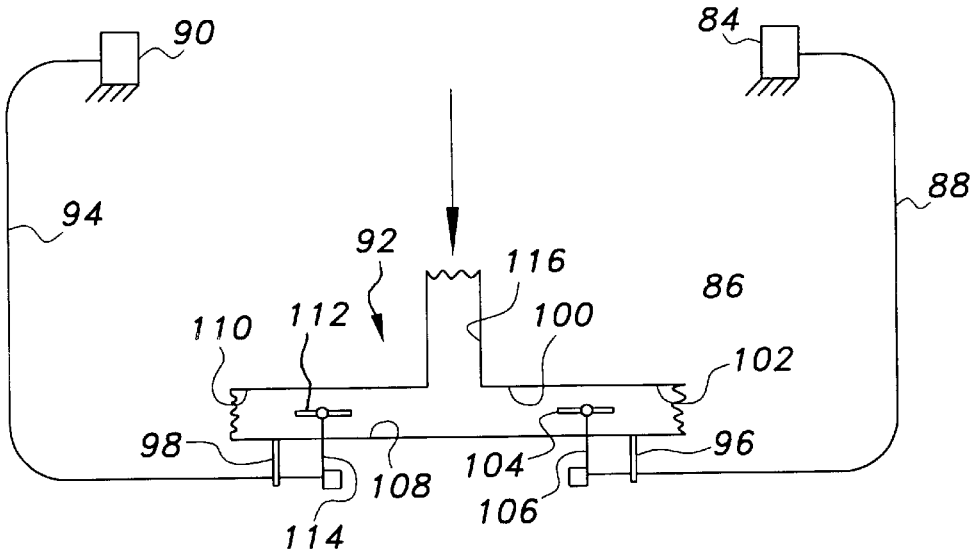
FIG. 9 is a schematic view of a second embodiment of a steering mechanism used with the exhaust system of the present invention.
Figure 15:
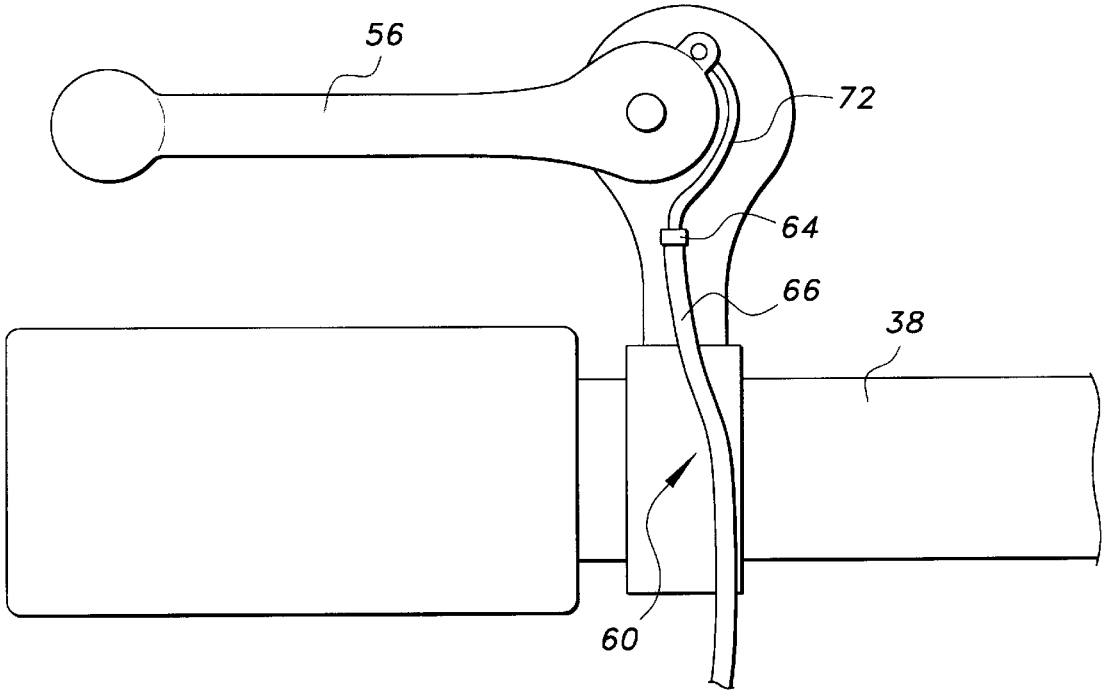
FIG. 15 is a fragmentary view showing the lever for operating the single control cable for use with the present invention.

To provide a steering force, the exhaust system of the present invention, must unevenly distribute the exhaust gases between the left sponson 32 and the right sponson 34. FIGS. 8 and 9 illustrate the mechanisms used to provide this function. In FIGS. 8 and 15, a lever 56 is mounted on the handle bars 38 of the PWC. The lever 56 is operatively connected to a three position butterfly-type exhaust valve 58 by a cable 60. Brackets 62 and 64 hold the ends of the sheath 66 of the cable 60 motionless relative to the valve 58 and the lever 56, respectively. The three position exhaust valve 58 has a movable member 68 which is pivotally mounted with the valve body. A lever arm 70 is positioned outside the valve body but is operatively connected to the moving member 68 so as to pivot with the moving member 68. Thus pivoting the lever arm 70 will cause the moving member 68 to pivotally move to different positions within the valve body. The core wire 72 extends through the brackets 62 and 64, with one end being fixed to the distal end of the lever arm 70 and the other end being fixed to the lever 56. The body of valve 58 includes an inlet 74 which is in fluid communication with or, is operatively connected to, the PWC engine's exhaust outlet port. The body of valve 58 also includes first and second outlets 76 and 78 which are in fluid communication with right exhaust pipe 80 and left exhaust pipe 82, respectively. When the lever 56 is operated, the core wire 72 of the cable 60 is extended and retracted as is well known in the art of cable operated systems (such as cable operated bicycle brakes, or bicycle speed changers). As can be seen in FIG. 15, counter clockwise rotation of lever 56 retracts the end of the core wire 72, connected to the lever arm 70, into the sheath 66. The retraction of the wire 72, causes the lever arm 70 and the movable member 68 to pivot counter clockwise until the movable member 68 reaches a position where the outlet 76 is shut off from the inlet 74 while the outlet 78 is open to the inlet 74. This arrangement corresponds with the fully retracted configuration of the cable 60 and directs almost all (allowing for leakage around the movable member 68) of the exhaust gas to the left exhaust pipe. Turning the lever 56 in the clockwise direction, more of the core wire 72 is extended out of the sheath 66 through the bracket 62. The wire 72 has sufficient stiffness to sustain compressive stress over short distances, thus the wire 72 pushes the lever arm 70 away from the bracket 62 in the process turning the movable member 68 in the clockwise direction. Turning the lever 56 in the clockwise direction as far as possible will rotate the movable member 68 in the counter clockwise direction until the movable member 68 reaches a position where the outlet 78 is shut off from the inlet 74 while the outlet 76 is open to the inlet 74. This arrangement corresponds with the fully extended configuration of the cable 60 and directs almost all of the exhaust gas to the right exhaust pipe. In the fully extended position, the valve 58 connects the valve inlet 74 to the first outlet 76 which is connected to the right exhaust pipe, and when the cable 60 is fully retracted, the three position exhaust valve 58 connects the valve inlet 74 to the left exhaust pipe via the outlet 78. When the Lever 56 (and consequently the cable 60) are in intermediate positions, the exhaust valve 58 variably distributes the exhaust gases between the left and right exhaust pipes 82 and 80. It should be noted that the connections of the left and right exhaust pipes to the valve 58 may be switched from the configuration described with reference to FIG. 8, depending on the desired operation.

In FIG. 9, the lever 56 is replaced with foot pedals. A right foot pedal 84, is operatively connected to a first exhaust valve 86 by a first cable 88. Similarly, a left foot pedal 90, is operatively connected to a second exhaust valve 92 by a second cable 94. Bracket 96 holds the sheath of cable 88, while bracket 98 holds the sheath of cable 94. The right exhaust valve 86 has an inlet 100 and an outlet 102. The valve 86 also has a movable member 104 which is pivotally supported in the valve body. A lever arm 106 allows the movable member 104 to be moved from outside the valve body. Similarly, the left exhaust valve 92 has an inlet 108 and an outlet 110. The valve 92 has a movable member 112 which is pivotally supported in the valve body. A lever arm 114 allows the movable member 112 to be moved from outside the valve body. The inlets of the valves 86 and 92 are operatively connected to the exhaust outlet port of the engine (not shown) via the T-shaped conduit 116. The right exhaust valve outlet 102 is operatively connected to the right exhaust pipe 80, while the left exhaust valve outlet 110 is operatively connected to the left exhaust pipe 82. The right exhaust valve 86 provides a variable flow path between the right exhaust valve inlet 100 and the right exhaust outlet 102 based on the depression of the right pedal 84 (and consequent retraction or extension, preferably retraction, of the first cable 88). The left exhaust valve 92 provides a variable flow path between the left exhaust valve inlet 108 and the left exhaust outlet 110 based on the depression of the left pedal 90 (and consequent retraction or extension of the second cable 94). The pedals allow independent control of the right and left exhaust output through the sponsons. This is useful for both steering and attitude control of the PWC.

In addition to the manual control of the exhaust distribution by a lever or pedals, the present invention also includes automatic control. Referring back to FIG. 8, cable 60 is shown alternatively connected (dotted line 61) to handle bars 38. In the basic embodiment, cable 60 is connected to the handle bars 38 such that when the handle bars 38 are turned to the left, valve 58 diverts the exhaust to the left sponson 32, and when turned to the right, exhaust is diverted to the right sponson 34. In this way, even when the throttle is off, a turning force is imparted to the PWC (by pushing the rear of the PWC in the opposite direction of the desired turn).

In the preferred embodiment, the cable 60 is controlled by an electrical device (such as a servomotor) and control electronics are included. It should be noted that the cable 60 could be eliminated and a servomotor would directly operate valve 58. A major advantage of an electrically controlled system is the ability to turn off the exhaust distribution using an electrical switch. In addition, several electrical sensors could be used to determine the ideal exhaust distribution. This is important as steering considerations are only part of the objectives of the exhaust system of the present invention. Referring to FIG. 2, side to side rolling forces can be offset by directing exhaust gases to the sponson on the lower side of the PWC. By placing the sponsons at the point where the hull has the greatest width, these forces are maximized. Porting the exhaust to the lowered sponson has the additional advantage of reducing exhaust noise by insuring that the exhaust is released underwater, and not through the sponson that is raised out of the water.

Referring to FIG. 2, the rearward disposition of the sponsons relative to the center of gravity CG creates a forward roll, thereby increasing the wetted keel area, and reducing porpoising. This forward roll is increased by lowering the sponsons relative to the hull of the PWC. As previously discussed, this can be accomplished using a hand lever, foot lever, or via steering and/or hull position sensors (such as accelerometers or leveling sensors). It should be noted that any of the above described methods of directing the exhaust, must also take into account back pressure and overall engine performance. Development of the final distribution is considered a tuning step that would trim the system for a particular application. In addition to steering control with an idling engine, the exhaust system of the present invention can enhance the turning ability of a PWC at high speed, thus the exhaust system of the present invention may be useful in slalom type racing events.

Figure 10:
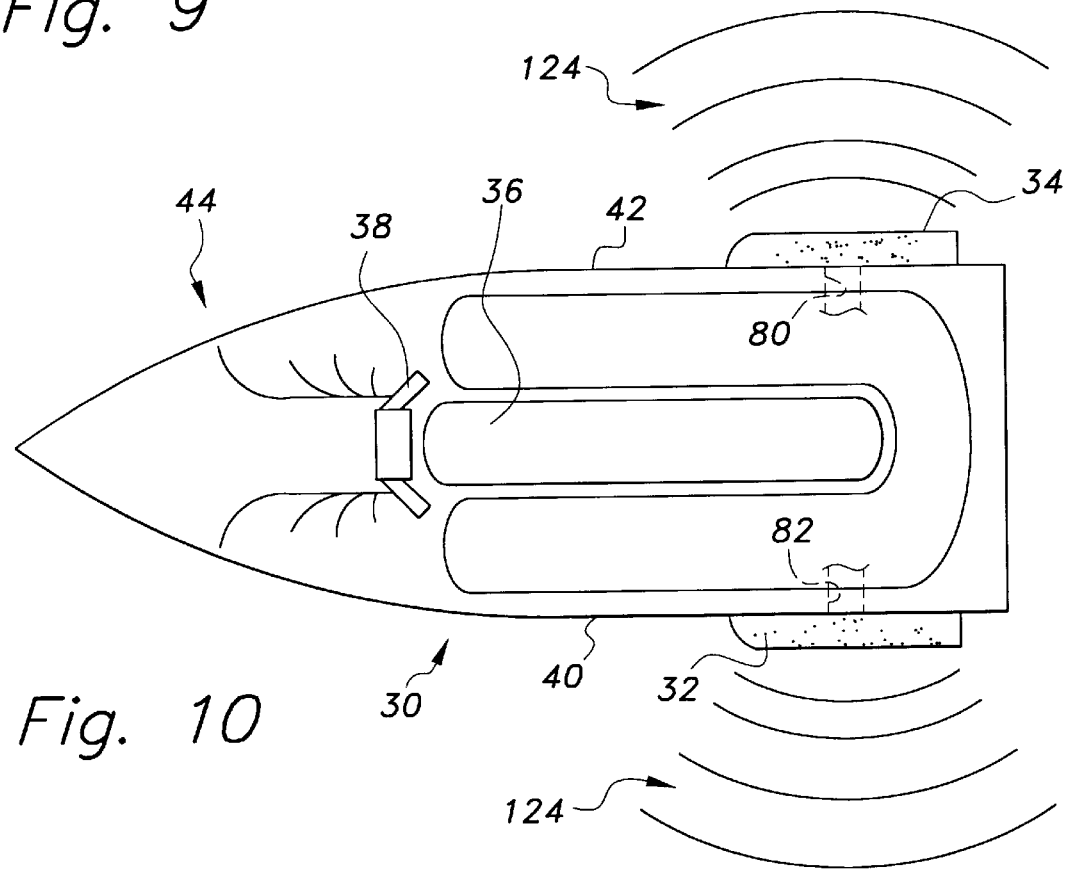
FIG. 10 is a diagrammatical view showing how sound radiates from a watercraft having the exhaust system of the present invention.
Figure 11:
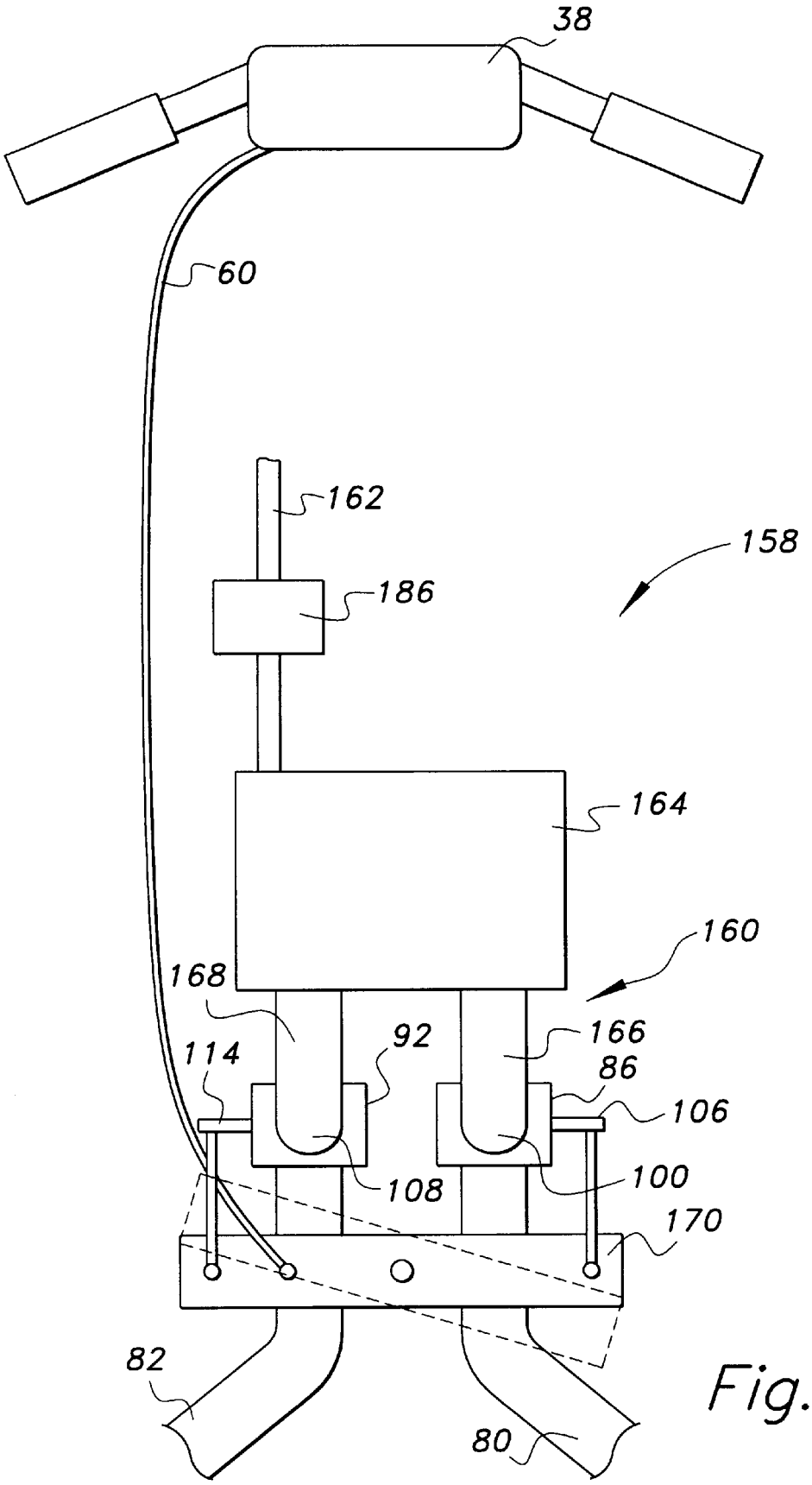
FIG. 11 is a diagrammatic view of the exhaust system using two valves in conjunction with single cable control.
Figure 12:
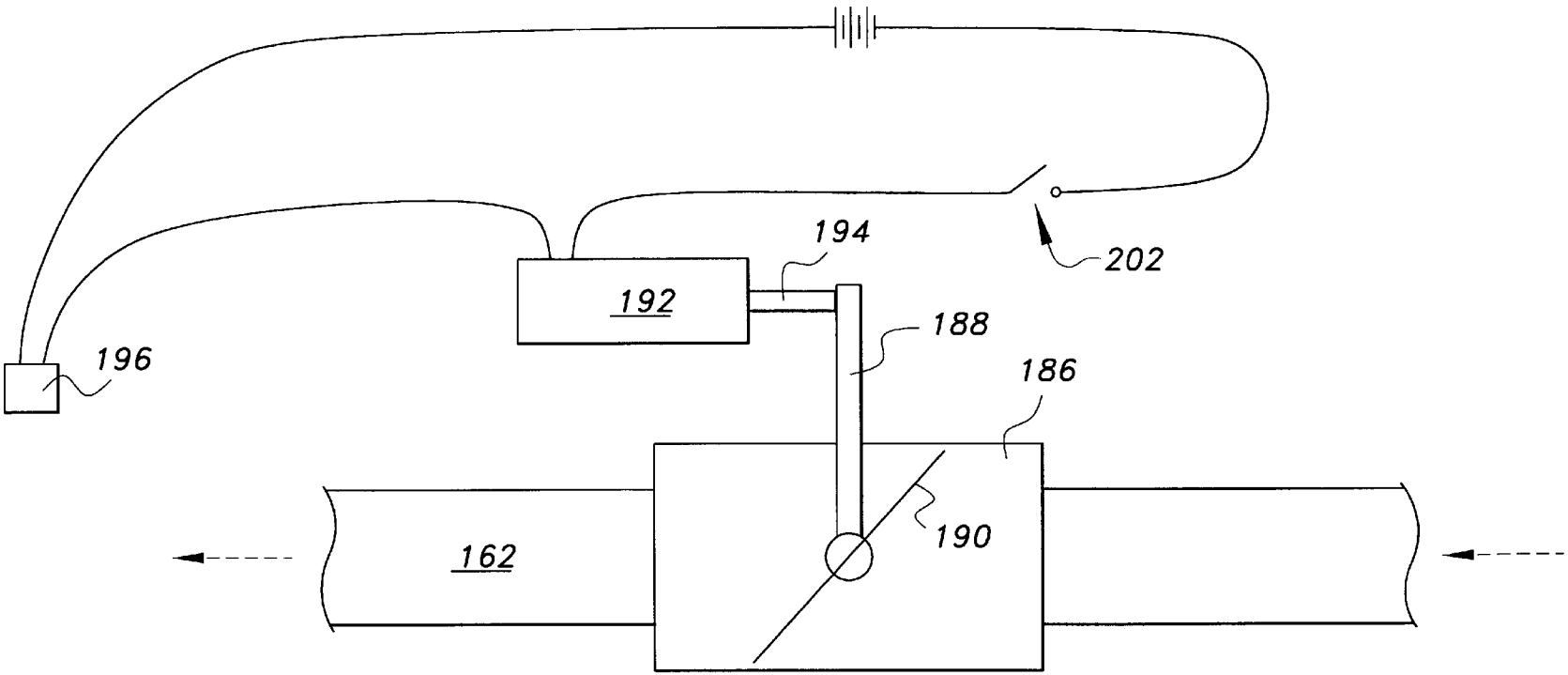
FIG. 12 is a diagrammatical view of the exhaust gas shut off system activated when the personal water craft leaps from the water.
Figure 13:
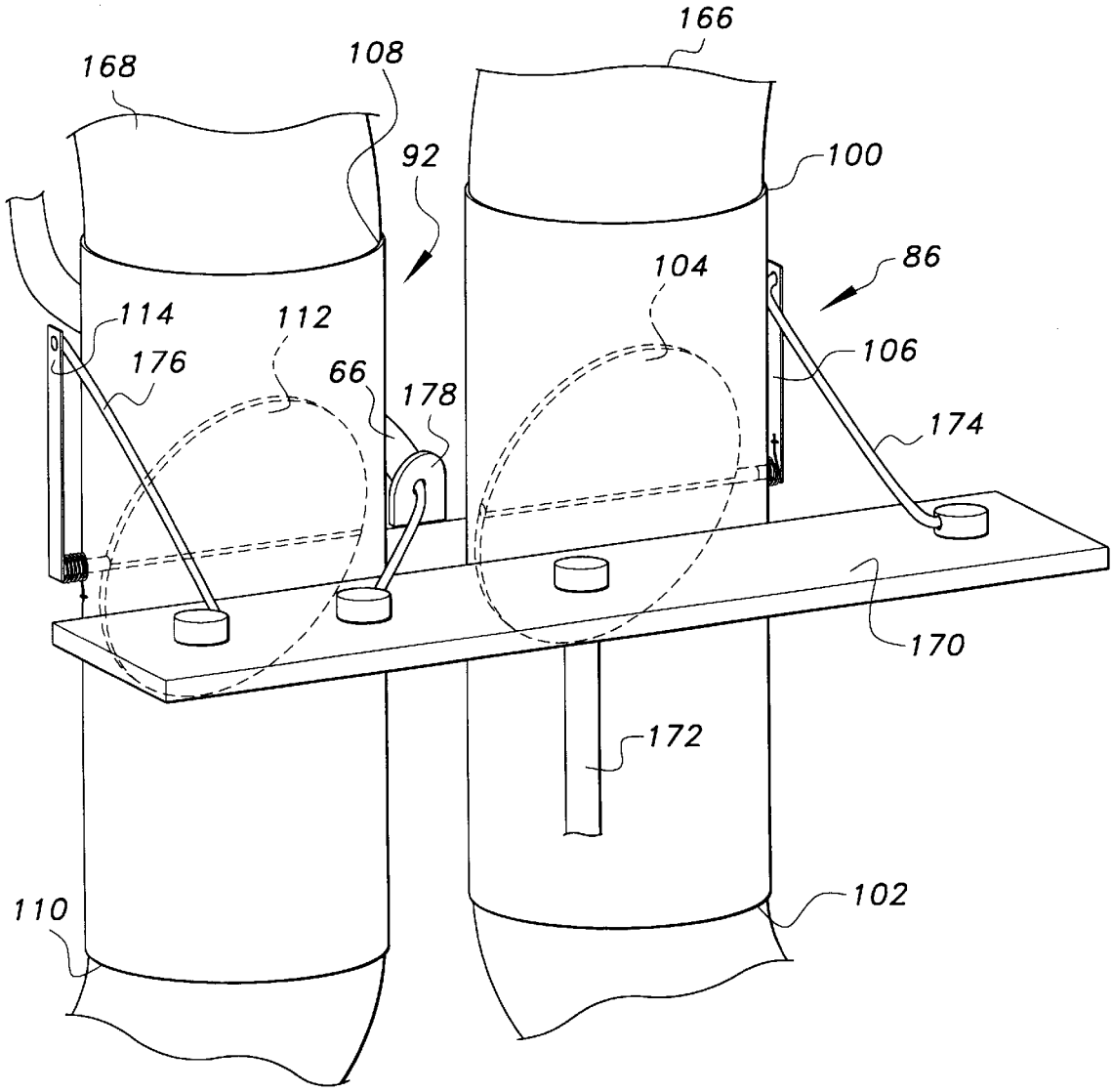
FIG. 13 is a perspective view of the arrangement of the valves in the embodiment using two valves and single cable control for steering using exhaust gas.
Figure 20:
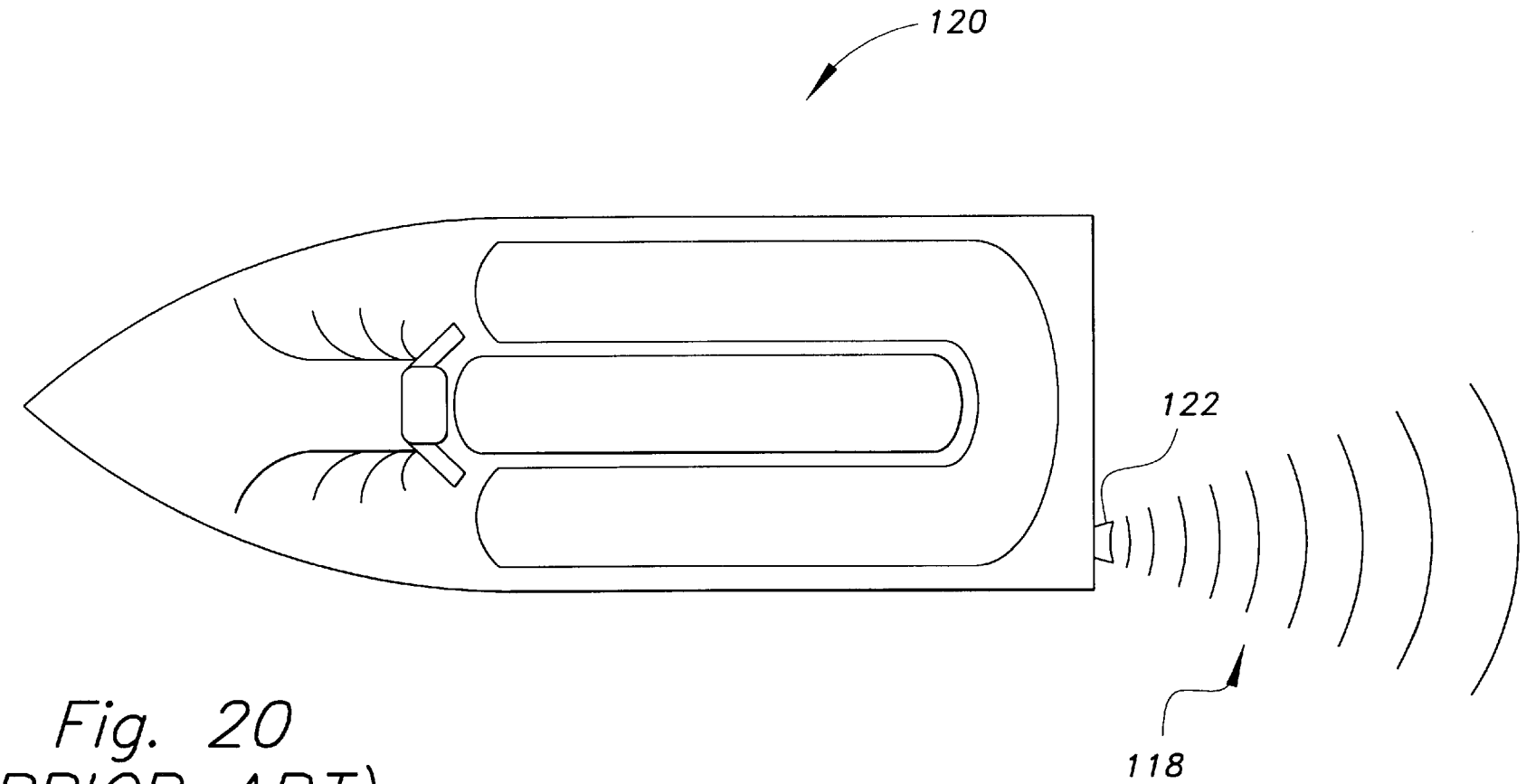
Fig. 20 (PRIOR ART)
FIG. 20 is a diagrammatical view showing how sound radiates from a watercraft having a prior art exhaust system.

While the present invention provides a greater level of control in PWCs, a primary advantage is the reduction of noise. FIG. 20 illustrates the sound radiation field 118 associated with a prior art PWC 120. The exhaust outlet 122 is above water and sound radiates rearwardly from a single point. Sound intensity, I can be expressed as power W divided by the area A of the three dimensional wave front. The area A of the wave front is equal to $\pi R^2$; R being the distance from the exhaust outlet. FIG. 10 illustrates the sound radiation fields 124 associated with a PWC 30 having the sponsons 32 and 34 of the present invention. The sound intensity I is divided between the two sides of the PWC 30 providing a 50% reduction (assuming an even exhaust distribution). For a PWC traveling parallel to the shore, half of the exhaust is directed toward the shore and half away from the shore. Further, the release of exhaust on the sides of the hull provides additional attenuation by forcing the sound waves to travel through the water spray (or curtain) created at higher speeds. The water spray scatters and absorbs the sound waves.

An even greater degree of noise reduction is achieved by using tuning chambers in conjunction with the above described exhaust system. The tuning chambers may be integral with the sponsons, or separate chambers may be provided within the hull of the PWC. Two alternate embodiments (34*a* and 34*b*) of the sponsons 32 and 34, including integral tuning chambers, are shown diagrammatically as top, cross-sectional views in FIGS. 5 and 6. These embodiments have been drawn with respect to the right sponson 34, and it should be noted that these drawings would be a mirror image in the case of left sponson 32. The first of these sponsons 34*a* (FIG. 5) includes a Hemholtz resonator. Exhaust gases enter the sponson 34*a* at exhaust inlet 126 through the right side 42 of the hull. Main chamber 128 includes two rows of apertures 54 through which the exhaust gases are released. A forwardly situated Hemholtz resonator 130, is connected to the main chamber 128 by a Hemholtz resonator inlet 132 or inlets in partition 134. The main chamber 128 is bounded by the top surface 46, the bottom surface 48, and the rear surface 50 of the sponson 34*a*, partition 134, and the side of the hull 42 to which the sponson is attached. The Hemholtz resonator 130 is bounded by the top surface 46 and the bottom surface 48 of the sponson 34*a*, partition 134, and the side of the hull 42. It should be noted that the Hemholtz resonator could be constructed with many different configurations. The inlet(s) and resonator are tuned to minimize the resulting exhaust noise and tune vehicle performance.

Figure 6:
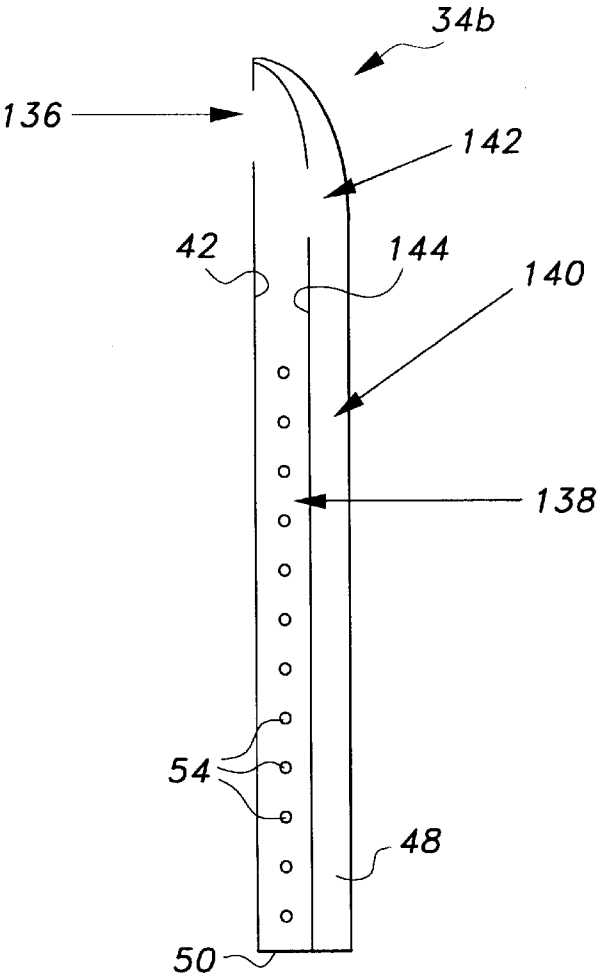
FIG. 6 is a diagrammatical view of a second embodiment of the sponsons.
Figure 5:
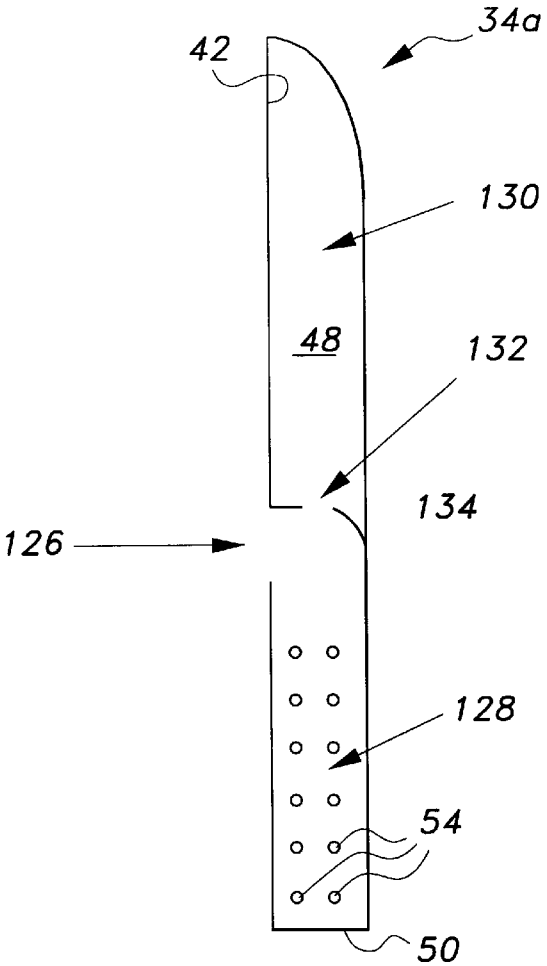
FIG. 5 is a diagrammatical view of a first embodiment of the sponsons.

The second embodiment of the sponsons is shown as 34*b* in FIG. 6. Sponson 34*b* include a quarter-wave tuner. Exhaust gases enter the sponson 34*b* at exhaust inlet 136 through the right side 42 of the hull. Main chamber 138 includes a single row of apertures 54 through which the exhaust gases are released. A outwardly situated quarter-wave tuner 140, is connected to the main chamber 138 by a quarter-wave tuner inlet 142 in partition 144. The main chamber 138 is bounded by the top surface 46 of the sponson 34*b*, the bottom surface 48 of the sponson 34*b*, the rear surface 50 of the sponson 34*b*, partition 144, and the side of the hull 42 to which the sponson is attached. The quarter-wave tuner 140 is bounded by the top surface 46 of the sponson 34*b*, the bottom surface 48 of the sponson 34*b*, the rear surface 50 of the sponson 34*b*, and partition 144. It should be noted that the quarter-wave tuner could be constructed with many different configurations. The inlet and tuner are tuned to minimize the resulting exhaust noise.

Figure 7:
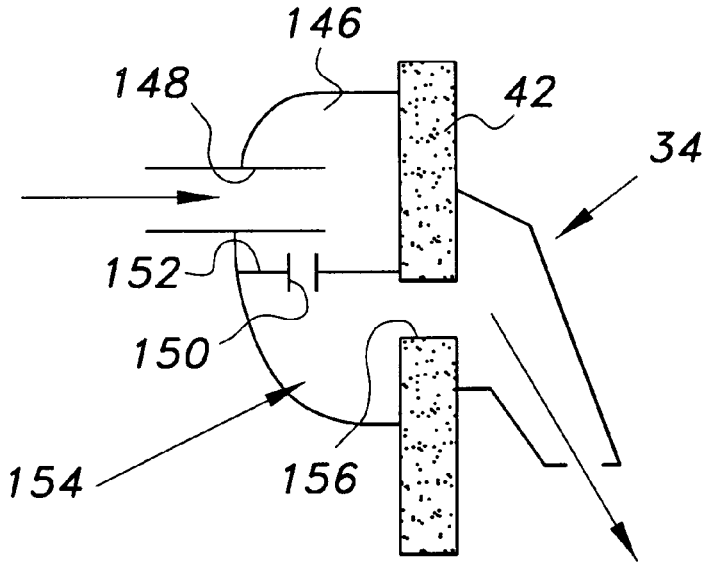
FIG. 7 is a diagrammatical view of a hull section showing the connection between the sponsons and the watercraft, and the path of the exhaust therethrough.

FIG. 7 illustrates the use of a separate tuning chamber or chambers within the hull of the PWC, in conjunction with the sponsons. Exhaust gases first enter a primary chamber 146 through exhaust inlet 148, and are then routed through port 150 in partition 152, to secondary chamber 154. From the secondary chamber 154, the exhaust is routed through a second port 156, in the right side 42 of the hull, and into the sponson 34 (32 for the left side). As with the integral chambers and ports described above, chambers 146 and 154, and ports 150 and 156 are tuned to minimize the resulting exhaust noise. It should also be noted that partition 152 (and port 150) can be eliminated, resulting in a single tuning chamber.

Referring to FIGS. 11–16, yet another embodiment of the present invention can be seen. It should be noted that the arrangements described for using exhaust gases to aid in steering can be practiced without having to use the sponsons 32 and 34, or the tuning chamber of FIG. 7. Also the devices disclosed herein for shutting off engine exhaust flow when the PWC leaves the water can be utilized without being part of an exhaust system designed to enhance steering control or one which utilizes the sponsons.

The embodiment of FIGS. 11–16 illustrates two aspects of the present invention which are managing exhaust gases for enhancing steering control and shutting off engine exhaust flow when the PWC leaves the water to reduce noise and wear on the PWC. The steering control aspect will be discussed first.

As with the previous embodiments the exhaust system of FIGS. 11–16 is for use with a PWC having an internal combustion engine with an exhaust outlet port (not shown). The internal combustion engine produces exhaust gases which are expelled through the engines exhaust outlet port. The PWC is the same as PWC 30 and has a hull having a bottom, a left sidewall 40, and a right sidewall 42.

The exhaust system of FIGS. 11–16 in essence combines single cable control, as shown in FIG. 8, with the two valve arrangement of the embodiment of FIG. 9, to accomplish its steering functions. However, certain unique mechanical linkages are necessary to implement the above combination, and these linkages will be discussed below.

The exhaust system 158 includes left and right exhaust pipes 82 and 80 as before. The exhaust system 158 also includes means 160 for selectively directing a greater portion of the exhaust gases from the engine to one or the other of the left and right exhaust pipes 82 and 80. Exhaust gases from the engine are conducted to the means 160 for selective direction to the left and right exhaust pipes by a fluid conductor 162. The fluid conductor 162 can be any type of pipe, duct, conduit, or vessel suitable for handling the hot exhaust gases.

The fluid conductor 162 carries the exhaust gases to a bifurcated fluid conductor which car be any type of pipe, duct, conduit, or vessel suitable for handling the hot exhaust gases, and having one inlet and two outlets. In the illustrated example, the fluid conductor 162 carries the exhaust gas to a muffler 164. The muffler 164 has two outlets 166 and 168 which communicate with the inlet 100 of the first exhaust valve 86 and the inlet 108 of the second exhaust valve 92, respectively.

The outlet 102 of the first exhaust valve 86 and the outlet 110 of the second exhaust valve 92 communicate with the right and left exhaust pipes 80 and 82, respectively. The valve 86 has a movable member 104 which is pivotally supported in the valve body. A lever arm 106 allows the movable member 104 to be moved from outside the valve body. Similarly, the left exhaust valve 92 has a movable member 112 which is pivotally supported in the valve body. A lever arm 114 allows the movable member 112 to be moved from outside the valve body. The movable bodies are spring biased to ordinarily stay in the open position and evenly distribute the exhaust gases between the right and left exhaust pipes 80 and 82.

A swivel linkage 170 having a first end, a second end and a center, is pivotally supported by a rod 172 extending from the bottom of the hull. The swivel linkage 170 is supported at its center. A tether 174 connects the first end of the swivel linkage 170 to the distal end of the lever arm 106. Similarly, a tether 176 connects the second end of the swivel linkage 170 to the distal end of the lever arm 114. As should be readily apparent from the structure depicted in FIG. 13, clockwise pivoting of the swivel linkage 170 pulls down the lever arm 106 while leaving the lever arm 114 undisturbed. As the lever arm 106 comes down, the movable member 104 increasingly obstructs the bore of the valve body, thus an increasingly greater portion of the exhaust gas is directed through the left exhaust pipe 82. This uneven distribution of exhaust gas results in a steering force tending to steer the PWC to the left, given that the exhaust pipes are positioned to the rear of the PWC's center of gravity.

Counter clockwise pivoting of the swivel linkage 170 pulls down the lever arm 114 while leaving the lever arm 106 undisturbed. As the lever arm 114 comes down, the movable member 112 increasingly obstructs the bore of the valve body, thus an increasingly greater portion of the exhaust gas is directed through the right exhaust pipe 80. This uneven distribution of exhaust gas results in a steering force tending o steer the PWC to the right, again given that the exhaust pipes are positioned to the rear of the PWC's center of gravity.

One end of the core wire 72 is fixed to the swivel linkage 170 intermediate the center and the second end of the swivel linkage A bracket 178 holds the end of the sheath 66, proximate to the swivel linkage 170, stationary. When the core wire 72 is pulled, the end of the wire 72 attached Lo the swivel linkage 170, is retracted toward the sheath 66 tending to rotate the swivel linkage 170 in the clockwise direction. When the core wire 72 is pushed through the sheath 66, the end of the wire 72 attached to the swivel linkage 170, is extended from the sheath 66 tending to rotate the swivel linkage 170 in the counter clockwise direction. Note that as was previously mentioned, the wire 72 can sustain compressive stress over short distances and can thus push the swivel linkage 170.

Figure 14:
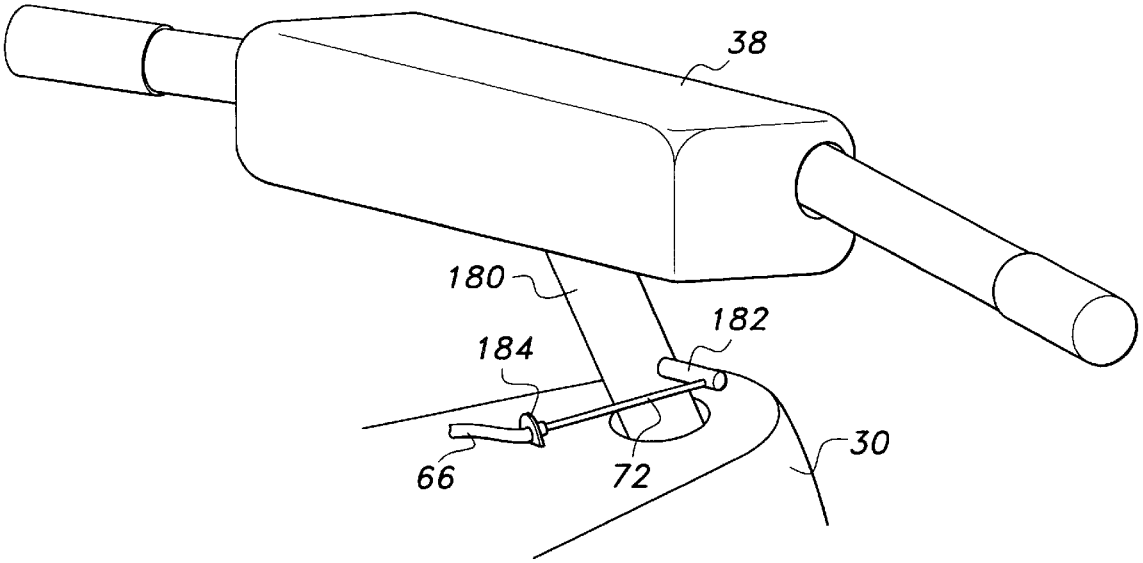
FIG. 14 is a fragmentary view of the attachment of the control cable to the steering column.

Retraction and extension of the wire 72, this being synonymous with retraction and extension of the cable 60 for simplicity, can be accomplished using the means illustrated in FIG. 15 and discussed previously. Also the steering column attachment shown in FIG. 14 can also be used to accomplish retraction and extension of the cable 60. This arrangement can also be used with the embodiment of FIG. 8. In FIG. 14 the steering column 180 has a projection 182 to which an end of the wire 72 is fixed. A bracket 184 fixed to the PWC holds the end of the sheath 66, near the steering column 180, stationary relative to the steering column 180. With this arrangement, if the handle bars 38 are turned counter clockwise the wire 72 is pulled through the sheath 66 and the end of the wire 72, attached to the swivel linkage 170, is retracted which causes a steering force to the left. If the handle bars 38 are turned clockwise the wire 72 is pushed through the sheath 66 and the end of the wire 72, attached to the swivel linkage 170, is extended which causes a steering force to the right. Thus the forces caused by the exhaust system acts in synchrony with the steering force due Lo the main propelling jet of the PWC at speed. With the engine at idle, the exhaust system 158 generates the bulk of the steering force.

A third butterfly valve 186 similar to valves 86 and 92 is provided intermediate the engine and the selective exhaust gas distribution means 160. The valve 186 is biased toward the closed position which shuts off the emission of exhaust gases from the engine. The lever 188 pivots in unison with the movable member 190 and allows the movable member 190 to be moved from outside the body of valve 186. A solenoid 192 having a linearly travelling member 194 is positioned near the lever 188. When the solenoid 192 is energized, the linearly travelling member 194 impinges upon the lever arm 188 and pushes the lever arm 188 to keep valve 186 open. The solenoid 192 must be constantly energized to keep the valve 186 open an allow exhaust gas discharge from the engine. A float switch 196 is provided in the power supply circuit to the solenoid 192. The float switch 196 cuts off power to the solenoid 192 when the float switch is lifted out of the water, thus shutting off the exhaust gas flow from the engine.

Figure 16:
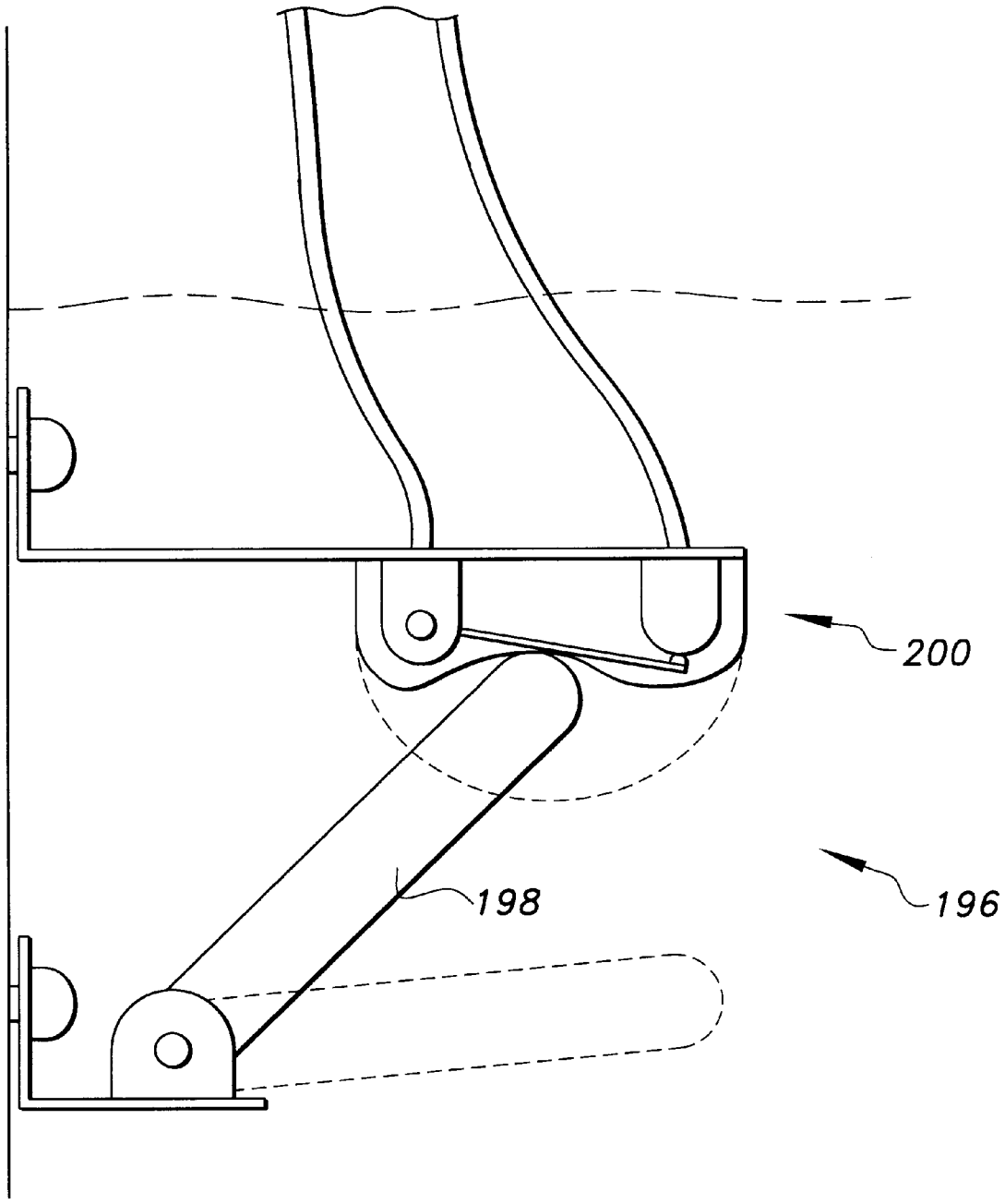
FIG. 16 is a fragmentary view showing the float switch for use with the present invention.

FIG. 16 shows the float switch 196. When submerged the float 198 rises and closes the water proof switch 200, thus maintaining power to the solenoid 192. The float switch 196 is located at the rear of the PWC, below the water line so that normally the flow path of the exhaust gases is kept open. When travelling over the water at high speed, especially when there is chop on the water, the PWC tends to intermittently jump clear of the water. At these times the flow of water through the propelling jet is interrupted, resulting in the propeller freewheeling and the engine revving unnecessarily to high RPM. Shutting oft the exhaust flow prevents this unnecessary revving which can damage the engine and causes an obnoxiously load noise. The duration over which the exhaust flow is shut off is too brief to cause the engine to stall.

When the float is clear of the water the float 198 losses contact with the switch 200 thereby de-energizing the solenoid 192 and closing the valve 186. A manual switch 202 can be used to disable the float switch and solenoid system.

Figure 18:
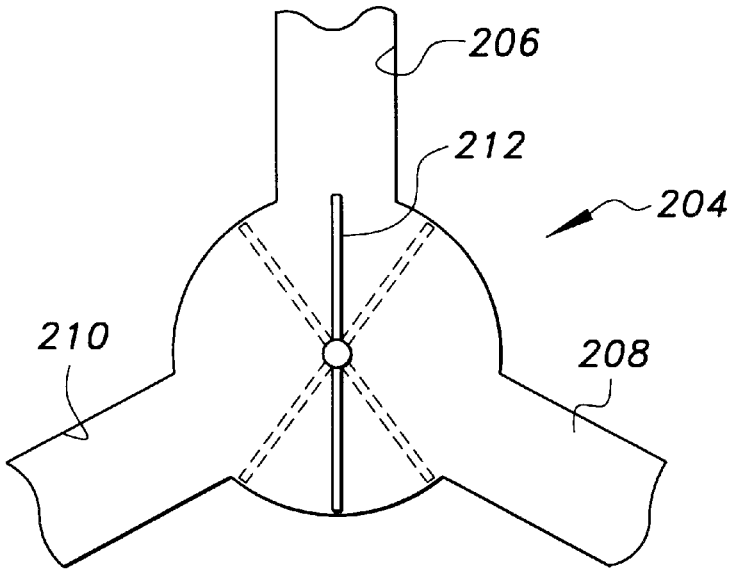
FIG. 18 is a schematic view of a four position valve for use with the present invention.
Figure 19:
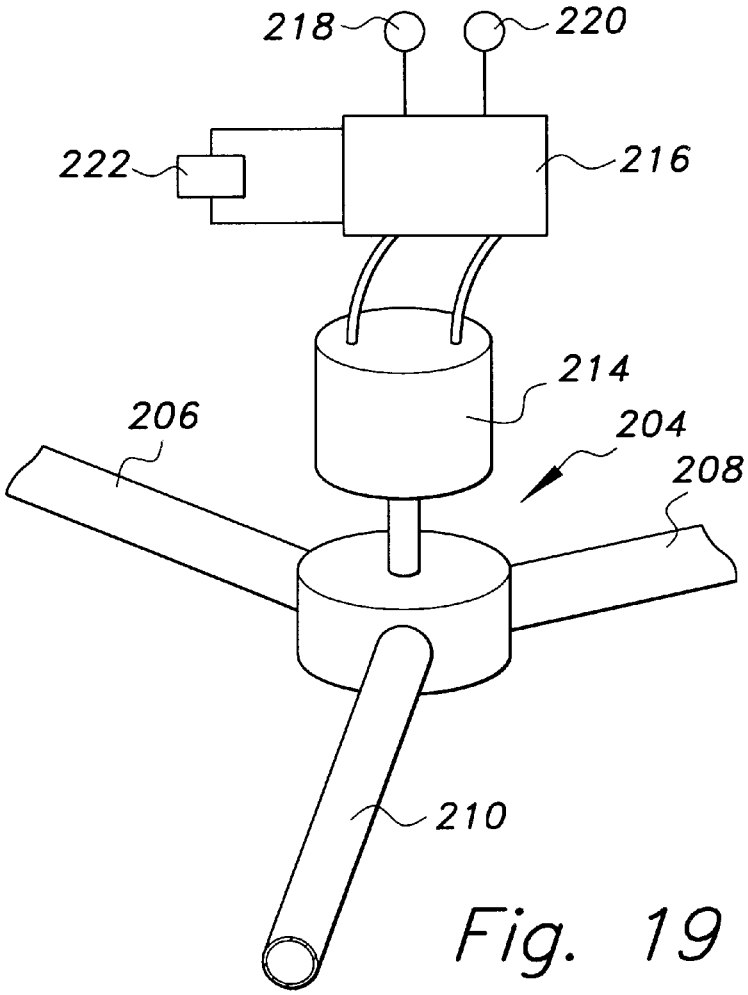
FIG. 19 is a schematic view of the control circuit for controlling a four position valve for use with the present invention.

Referring to FIGS. 18 and 19, a four position valve 204 having an inlet 206, a first outlet 208, and a second outlet 210 can be seen. The four position valve can perform the functions of all the valves 86, 92, 186. The four position valve has a movable member 212. The movable member 212 is movable to a first position, a second position, a third position, and a fourth position. In the first position, the movable member 212 allows fluid communication between the inlet 206 and the first outlet 208 of the four position valve 204. When the movable member 212 is in the second position, the movable member allows fluid communication between the inlet 206 and the second outlet 210 of the four position valve 204. When the movable member 212 is in the third position, the movable member 212 allows fluid communication between the inlet 206 and both the first and second outlets 208 and 210. In the fourth position, the movable member 212 shuts off fluid communication between the inlet 206 and both the first and second outlets 208 and 210.

When installed the conduit 162 will be connected to the inlet 206, the right exhaust pipe 80 will be connected to the outlet 208, and the left exhaust pipe 82 will be connected to the outlet 210. The valve 204 is operated by a servo-motor 214. The servo-motor would be controlled by a circuit 216 based upon inputs of a sensor 218 and a user input 220. The sensor must signal when the PWC is out of the water. Appropriate sensors are the float switch 196, a flow or pressure sensor in the water jet propulsion duct, or an engine torque or RPM sensor. Any of these sensors can sense the condition wherein the PWC is out of the water.

The control circuit 216 can be programmed to direct exhaust gas to the left or right side in proportion to how much to that side the handle bars 38 are turned. When the sensor 218 senses that the PWC is out of the water, the valve 204 would be completely shut off. The sensor signal would override all other inputs. Item 222 is a diagrammatic depiction of the system's power supply.

Referring to FIG. 17, an alternative sponson 34*c* can be seen. Unlike sponson 34, sponson 34*c* is streamlined at both ends, such that the top 46*c* meets the bottom 48*c* at both the front and the back of the sponson, and the sponson 34*c* has holes 54 only on the bottom 48*c*.

It is to be understood that the present invention is not limited to the embodiments described above, but encompasses any and all embodiments within the scope of the following claims.

I claim:

1. An exhaust system for a watercraft having an internal combustion engine with an exhaust outlet port, the internal combustion engine producing exhaust gases which are expelled through the exhaust outlet port, a hull having a bottom, a left sidewall, and a right sidewall, the watercraft further having a centerline with a left side and a right side, the exhaust system comprising:

a right exhaust pipe extending through said right sidewall;

a left exhaust pipe extending through said left sidewall; and means for directing the exhaust gases from the exhaust outlet port to at least one of said right exhaust pipe and said left exhaust pipe, wherein said means for directing the exhaust gases includes means for selectively directing a greater portion of the exhaust gases to said right exhaust pipe to generate a steering force tending to steer the watercraft in a first direction and selectively directing a greater portion of the exhaust gases to said left exhaust pipe to generate a steering force tending to steer the watercraft in a second direction;

wherein said means for selectively directing a greater portion of the exhaust gases includes:

a bifurcated fluid conductor having an inlet, a first outlet, and a second outlet;

a fluid conductor extending from the exhaust outlet port to said inlet of said bifurcated fluid conductor;

a first exhaust valve having an inlet, an outlet, and a first movable member, said first movable member being movable between a first open position and a first closed position, said first exhaust valve allowing fluid to pass therethrough when said first movable member is in said first open position, said first exhaust valve substantially preventing fluid passage therethrough when said first movable member is in said first closed position, said first outlet of said bifurcated fluid conductor communicating with said inlet of said first exhaust valve, and said outlet of said first exhaust valve communicating with said right exhaust pipe; and a second exhaust valve having an inlet, an outlet, and a second movable member, said second movable member being movable between a second open position and a second closed position, said second exhaust valve allowing fluid to pass therethrough when said second movable member is in said second open position, said second exhaust valve substantially preventing fluid passage therethrough when said second movable member is in said second closed position, said second outlet of said bifurcated fluid conductor communicating with said inlet of said second exhaust valve, and said outlet of said second exhaust valve communicating with said left exhaust pipe.

2. The exhaust system for a watercraft according to claim 1, further comprising:

a right sponson having a bottom surface with a first plurality of apertures and being adapted to be attached to the right sidewall exteriorly to the hull of the watercraft to form a first interior space, said right exhaust pipe communicating with said first interior space; and a left sponson having a bottom surface with a second plurality of apertures and being adapted to be attached to the left sidewall exteriorly to the hull of the watercraft to form a second interior space, said left exhaust pipe communicating with said second interior space, the exhaust gases expelled from the exhaust outlet port being routed through at least one of said first plurality of apertures and said second plurality of apertures, whereby said right and left sponsons aid in reducing noise generated by the exhaust gases.

3. The exhaust system for a watercraft according to claim 2, wherein when the watercraft is placed in a body of water having a surface, a portion of the hull rests below the surface of the body of water, the surface of the body of water defines a waterline, and said right and left sponsons are positioned on the hull such that the exhaust gases exiting through said at least one of said first and second plurality of apertures are released below the waterline at idle speed.

4. The exhaust system for a watercraft according to claim 1, wherein the first direction is to the right side of the centerline of the watercraft, and the second direction is to the left side of the centerline of the watercraft.

5. The exhaust system for a watercraft according to claim 1, wherein said means for selectively directing a greater portion of the exhaust gases further includes:

a first cable;

a right pedal, said first cable operatively connecting said right pedal and said first exhaust valve such that said first movable member moves between said first open position and said first closed position responsive to movement of said right pedal by a user;

a second cable;

a left pedal, said second cable operatively connecting said left pedal and said second exhaust valve such that said second movable member moves between said second open position and said second closed position responsive to movement of said left pedal by a user;

whereby a user can direct a greater portion of the exhaust gases from the exhaust outlet port to a selected one of said right exhaust pipe and said left exhaust pipe.

6. The exhaust system for a watercraft according to claim 1, wherein said means for selectively directing a greater portion of the exhaust gases further includes:

a swivel linkage having a first end, a second end and a center, said swivel linkage being pivotally supported at said center thereof proximate said first and second exhaust valves, said first end of said swivel linkage being mechanically linked to said first movable member, said second end of said swivel linkage being mechanically linked to said second movable member, said swivel linkage being pivotally movable between a relaxed position and a first applied position and between said relaxed position and a second applied position, said swivel linkage pivoting in opposite directions to reach said first and second applied positions, said swivel linkage shutting off said second exhaust valve when in said first applied position, said swivel linkage shutting off said first exhaust valve when in said second applied position, and both said first and second exhaust valves being open when said swivel linkage is in said relaxed position; and a cable linked to said swivel linkage, whereby said swivel linkage pivotally moves between said first applied position and said second applied position.

7. The exhaust system for a watercraft according to claim 1, further comprising:

a third exhaust valve placed in the exhaust system intermediate the exhaust outlet port and said inlet of said bifurcated fluid conductor, said third exhaust valve having a third movable member, said third movable member being movable between a third open position and a third closed position, said third exhaust valve allowing fluid to pass therethrough when said third movable member is in said third open position, said third exhaust valve substantially preventing fluid passage therethrough when said third movable member is in said third closed position, said third movable member being biased toward said third closed position;

a lever arm linked to said third movable member;

a solenoid having a linearly travelling member which impinges said lever arm, said solenoid being energized to maintain said third movable member in said third open, position; and a float switch adapted to be attached to the hull, said float switch interrupting power to said solenoid to thereby automatically shut off the exhaust outlet port when the watercraft leaves the water.

8. An exhaust system for a watercraft having an internal combustion engine with an exhaust outlet port, the internal combustion engine producing exhaust gases which are expelled through the exhaust outlet port, a hull having a bottom, a left sidewall, and a right sidewall, the watercraft further having a centerline with a left side and a right side, the exhaust system comprising:

a right exhaust pipe extending through said right sidewall;

a left exhaust pipe extending through said left sidewall; and means for directing the exhaust gases from the exhaust outlet port to at least one of said right exhaust pipe and said left exhaust pipe, wherein said means for directing the exhaust gases includes means for selectively directing a greater portion of the exhaust gases to said right exhaust pipe to generate a steering force tending to steer the watercraft in a first direction and selectively directing a greater portion of the exhaust gases to said left exhaust pipe to generate a steering force tending to steer the watercraft in a second direction;

wherein said means for selectively directing a greater portion of the exhaust gases includes:

a four position valve having an inlet, a first outlet, and a second outlet, said four position valve further having a movable member, said movable member being movable to a first position, a second position, a third position, and a fourth position, said movable member allowing fluid communication between said inlet of said four position valve and said first outlet of said four position valve when said movable member is in said first position, said movable member allowing fluid communication between said inlet of said four position valve and said second outlet of said four position valve when said movable member is in said second position, said movable member allowing fluid communication between said inlet of said four position valve and both said first and said second outlets of said four position valve when said movable member is in said third position, and said movable member shutting off fluid communication between said inlet of said four position valve and both said first and said second outlets of said four position valve when said movable member is in said fourth position; and a fluid conductor extending from the exhaust outlet port to said inlet of said four position valve.

9. The exhaust system for a watercraft according to claim 8, wherein said means for selectively directing a greater portion of the exhaust gases further includes:

a float switch, and a servo motor having a drive shaft operatively linked to said movable member of said four position valve to thereby move said movable member to one of said first, second, third, and fourth positions in response to inputs from a user and said float switch.

10. An exhaust system for a watercraft having an internal combustion engine with an exhaust outlet port, the internal combustion engine producing exhaust gases which are expelled through the exhaust outlet port, a hull having a bottom, a left sidewall, a right sidewall, and a rear, when the watercraft is placed in a body of water having a surface, a portion of the hull rests below the surface of the body of water, the surface of the body of water defines a waterline, said exhaust system comprising:

a sensor for detecting that the water craft has left the water; and an automatic exhaust valve adapted to be placed downstream of the exhaust outlet port of the engine, said automatic exhaust valve substantially preventing fluid passage therethrough responsive to said sensor when the watercraft leaves the water at speed to thereby automatically shut off the exhaust outlet port when the watercraft leaves the water and thus prevent unnecessary revving of the engine and unnecessary noise generation.

11. The exhaust system for a watercraft according to claim 10, wherein said automatic exhaust valve includes:

a movable member, said movable member being movable between an open position and a closed position, said exhaust valve allowing fluid to pass therethrough when said movable member is in said open position, said exhaust valve substantially preventing fluid passage therethrough when said movable member is in said closed position, said movable member being biased toward said closed position;

a lever arm linked to said movable member;

a solenoid having a linearly travelling member which impinges said lever arm, said solenoid being energized to maintain said movable member in said open position; and wherein said sensor is a float switch adapted to be attached to the rear of said hull below the water line, said float switch interrupting power to said solenoid to thereby automatically shut off the exhaust outlet port when the watercraft leaves the water.

12. The exhaust system for a watercraft according to claim 2, wherein:

said right sponson includes a first chamber and a second chamber;

said left sponson includes a first chamber and a second chamber;

said first chamber and said second chamber of said right sponson are connected to each other by a first tuned port;

said first chamber and said second chamber of said left sponson are connected to each other by a second tuned port;

said right exhaust pipe extends into said first chamber of said right sponson;

said left exhaust pipe extends into said first chamber of said left sponson;

said plurality of apertures in said bottom of said right sponson are in communication with said first chamber of said right sponson; and said plurality of apertures in said bottom of said left sponson are in communication with said first chamber of said left sponson.

13. The exhaust system for a watercraft according to claim 1, further comprising:

a right tuned exhaust chamber, said right tuned exhaust chamber being adapted to be disposed inside the hull, said right exhaust pipe extending into said right tuned exhaust chamber; and a left tuned exhaust chamber, said left tuned exhaust chamber being adapted to be disposed inside the hull, said left exhaust pipe extending into said left tuned exhaust chamber.

* * * * *